US005572202A

United States Patent [19]

Regel et al.

[11] Patent Number: 5,572,202

[45] Date of Patent: Nov. 5, 1996

[54] TRAFFIC SIGNALLING SYSTEM

[76] Inventors: Kenneth E. Regel, 422 E. 1st. St., Kimberly, Wis. 54136; Kenneth G. Vandeyacht, 206 Edwards St., Combined Locks, Wis. 54113

[21] Appl. No.: 415,297

[22] Filed: Apr. 3, 1995

[51] Int. Cl.[6] ..... G08G 1/07

[52] U.S. Cl. ..... 340/917; 340/944

[58] Field of Search ..... 340/901, 902, 340/903, 904, 906, 907, 916, 917, 555, 908, 908.1, 933, 935, 925, 944, 918; 116/63 R

[56] References Cited

U.S. PATENT DOCUMENTS

| | | | |
|---|---|---|---|
| 2,903,674 | 9/1959 | Schwab | 340/33 |
| 3,881,169 | 4/1975 | Malach | 340/32 |
| 4,115,757 | 9/1978 | Blahunka | 340/32 |
| 4,849,735 | 7/1989 | Kirtley et al. | 340/539 |
| 4,908,615 | 3/1990 | Bayrakaroglu | 340/917 |
| 5,187,476 | 2/1993 | Hamer | 340/906 |

*Primary Examiner*—Jeffery Hofsass
*Assistant Examiner*—Timothy Edwards, Jr.
*Attorney, Agent, or Firm*—Tom Wilhelm; Brian Tumm

[57] ABSTRACT

This invention pertains to a traffic signalling system, and methods of use, for monitoring a signal zone about an intersection having at least two approach paths, detecting each target entering the signal zone, and giving warning visual display signals to traffic in approach paths outside the approach path occupied by the respective target. The traffic signalling system may direct a second visual display signal, different from the visual warning display, toward the approach path occupied by the respective target, and may indicate, in the visual warning displays, the approach path occupied by the respective target. The traffic signalling system may concurrently receive and process stimuli from first and second targets in respective first and second different approach paths, and indicate, to the targets in the respective approach paths occupied by the targets, the presence of the other target in the other approach path. Timing apparatus may be included in the traffic signalling system, for setting and running a delay timer which maintains the detection indication for the set time after the target has been detected.

36 Claims, 5 Drawing Sheets

TRAFFIC SIGNALLING SYSTEM

FIELD OF THE INVENTION

This invention relates to traffic signalling systems for signalling traffic information, and especially systems wherein the signalling system detects targets in a signal zone, and gives warning signals within the signal zone, responsive to targets detected.

BACKGROUND OF THE INVENTION

Intersections traversed by vehicular traffic present a known heightened level of risk to people and vehicles entering the intersection. At intersections having significant levels of traffic, it is common to install a traffic signalling system to control flow of traffic through the intersection.

Traffic signalling systems installed on open roadways typically operate on one of a few common principles. A first type of traffic signal operates on a time sequence, such that e.g. red, yellow, and green signal lights are illuminated in some sequence, based on a timing system.

A second type of traffic signal generally displays the same set of lights, but maintains a default setting giving a green light indication to a primary road until such time as traffic in a corresponding secondary road enters a signal zone or otherwise triggers a changing of the lights. Triggering of changing of the lights may initiate a timing or other system for subsequently returning the lights to the default setting. A first triggering mechanism, taught in U.S. Pat. No. 4,908,615 Bayraktaroglu, relies on a radio signal transmitter mounted at the traffic signalling system to detect traffic entering the intersection, and a magnetic presence detector 98 embedded in the road to detect traffic present in the intersection.

A second triggering mechanism, taught in U.S. Pat. No. 2,130,013 Hunter, relies on detectors A and B embedded in the road.

The signal devices disclosed in the above references generally provide stop and go directives to one or more approach paths to the intersection. Such signal devices do not, in general, indicate whether any traffic is in or approaching the intersection.

U.S. Pat. Nos. 2,903,674 Schwab, and 5,187,476 Hamer teach devices whereby an emergency vehicle can take control of the signal lights as it approaches the intersection.

U.S. Pat. No. 3,881,169 Malach teaches a signal system including a device 15, 16 which discriminates with respect to vehicles meeting certain criteria, and accordingly takes control of the signal lights.

U.S. Pat. No. 4,115,757 Blahunka teaches a signalling system for use with lift trucks in an industrial environment, wherein a transmitter on the lift truck cooperates with a receiver on a signalling system over the intersection, thus activating a strobe light to indicate the presence of traffic approaching the intersection.

None of the known references teach or suggest any apparatus or methods for monitoring a signal zone about an intersection, detecting each target entering the signal zone, and giving warning display signals to traffic in approach paths outside the approach path occupied by the respective target.

It is an objective of this invention to provide a traffic signalling system, for monitoring a signal zone about an intersection having at least two approach paths, detecting each target entering the signal zone, and giving warning visual display signals to traffic in approach paths outside the approach path occupied by the respective target.

Another object is to provide a traffic signalling system adapted to direct a second visual display signal, different from the visual warning display, toward the approach path occupied by the respective target.

It is another object to provide a traffic signalling system adapted to indicate, in the visual warning displays, the approach path occupied by the respective target.

Still another object is to provide a traffic signalling system adapted to concurrently receive and process stimuli from first and second targets in respective first and second different approach paths, and to indicate to the targets in each of the respective approach paths, the presence of a second target in a second approach path.

Yet another object is to provide a traffic signalling system including timing apparatus for setting and running a delay timer which maintains the detection indication for the set time after the target has been detected.

A further object is to provide methods for signalling traffic using a traffic signalling system providing the features and advantages of the above disclosed objects.

SUMMARY OF THE DISCLOSURE

Some of the objects are obtained in a first family of embodiments comprising a traffic signalling system, for detecting targets contained in any of at least two approach paths in a signal zone, and for providing signals responsive to the targets detected, the traffic signalling system comprising a presence detector effective to receive a minimum threshold stimulus, at one or more frequencies outside the human visible spectrum and outside the human audible spectrum, from each target entering the signal zone in any one of the at least two approach paths, and to generate output signals responsive to the stimuli so received; visual display apparatus for directing visual displays toward each of the at least two approach paths; and electrical processing circuitry for receiving and processing output signals from the presence detector, and for delivering corresponding warning display signals to the visual display apparatus, directing visual warning displays, representing the presence of the respective target, toward each of the at least two approach paths outside the approach path occupied by the respective target.

In a preferred traffic signalling system of the invention, the electrical processing circuitry is adapted to deliver, to the visual display apparatus, detection display signals, responsive to output signals received from the presence detector, thereby to direct a second visual display, different from the visual warning display, representing the presence of the respective target, toward the approach path occupied by the respective target.

In a further preferred embodiment, the display apparatus is adapted to indicate, in the visual warning displays directed toward each approach path outside the approach path occupied by the respective target, the approach path occupied by the respective target.

It is preferred that the traffic signalling system be adapted to concurrently receive and process first and second stimuli from first and second targets in respective first and second different ones of the approach paths, to concurrently generate respective first and second warning display signals from the first and second stimuli, and to concurrently deliver the first and second warning display signals to the visual display apparatus, indicating concurrent presence of the respective first and second targets in the respective approach paths, whereby the visual display apparatus concurrently directs visual warning displays, indicating presence of at least a second target in the signal zone, to each of the first and second approach paths. To each observer in the signal zone, he is the first target, and any target in another approach path represents a second etc. target. The first and second warning display signals are preferably generated from corresponding first and second output signals. The electronic processing circuitry may use the first and second warning display signals, in combination, to suppress any corresponding detection display signal, thereby to prevent display of the detection display signal in all approach paths.

Where the visual warning displays are adapted to indicate the approach path occupied by the respective target, and the traffic signalling system is adapted to concurrently receive and process first and second stimuli from first and second targets in respective first and second different ones of the approach paths, the traffic signalling system is preferably adapted to concurrently generate respective first and second warning display signals and to concurrently deliver the first and second warning display signals to the visual display apparatus and to indicate, by the visual display toward each of the at least two approach paths, the presence of respective targets in each of the approach paths outside the approach path toward which the visual display is directed, along with identification of the approach paths occupied by the targets.

Preferably, the electrical processing circuitry is adapted to generate corresponding ones of the warning display signals and the detection display signals from a common output signal received from the presence detector.

The presence detector may comprise a plurality of presence detector elements corresponding in number to the number of approach paths to be monitored by the signalling system, each such presence detector element being mounted in the traffic signalling system for dispositions toward a respective approach path.

In preferred embodiments, the traffic signalling system includes a timer for maintaining the output signal for a set delay time after a stimulus has been received by the presence detector, and reset circuitry for resetting the presence detector to a default setting at the end of the set delay time, thereby terminating the output signal, and desirably includes override circuitry for reinitializing the set delay time on the timer in response to stimulus in the respective approach path while the timer is timing a previous stimulus in the same approach path.

The traffic signalling system preferably includes an adjustment for adjusting the time over which the timer maintains the output signal after a stimulus has been received by the presence detector, with a set delay time of about 2 seconds to about 6 seconds being preferred.

The invention further comprehends a second family of embodiments, generally defined in a method for signalling traffic, by detecting targets in a signal zone having at least two approach paths, and providing signals responsive to targets detected, the method comprising the steps of detecting the presence of a target in any of the approach paths, using a presence detector effective to receive a minimum threshold stimulus, at one or more frequencies outside the human visible spectrum and outside the human audible spectrum, from each target entering the signal zone in anyone of the at least two approach paths and to generate output signals responsive to the stimuli so received; receiving and processing output signals from the presence detector in electrical processing circuitry, and delivering corresponding warning display signals from the electrical processing circuitry to a visual display apparatus; and directing visual warning displays, responsive to corresponding warning display signals, representing the presence of the respective target, toward each of the at least two approach paths outside the approach path occupied by the respective target.

In this family of embodiments, the method preferably includes delivering, from the electrical processing circuitry to the visual display apparatus, detection display signals, responsive to output signals received from the presence detector, thereby directing a second visual display, different from the visual warning display, representing the presence of the respective target, toward the approach path occupied by the respective target.

The method also preferably includes indicating, in the visual warning display directed toward each approach path outside the approach path occupied by the respective target, the approach path occupied by the respective target.

The method may include concurrently receiving and processing first and second stimuli from first and second targets in respective first and second different ones of the approach paths, and concurrently generating corresponding first and second output signals, and generating corresponding first and second warning display signals from the respective output signals, concurrently delivering the first and second warning display signals to the visual display apparatus, indicating concurrent presence of the respective first and second targets in the respective approach paths, thereby concurrently directing visual warning displays indicating the presence of at least a second target in the signal zone, to each of the first and second approach paths. The method optionally includes suppressing any corresponding detection display signal, and thereby preventing display of the detection display signal.

Where visual warning displays are adapted to indicate the approach path occupied by the respective target, and the traffic signalling system is adapted to concurrently receive and process first and second stimuli from first and second targets in respective first and second different ones of the approach paths, the method preferably includes concurrently receiving and processing stimuli from first and second targets in respective first and second different ones of the approach paths, and concurrently generating respective first and second warning display signals and concurrently delivering the first and second warning display signals to the visual display apparatus, and indicating by visual warning displays directed toward each of the at least two approach paths, the presence of respective targets in each of the approach paths outside the approach path to which the respective warning displays are directed, along with the identity of the approach paths so occupied by the targets.

The method may include generating, in the electrical processing circuitry, corresponding ones of the warning display signals and the detection display signals from a common output signal received from the presence detector.

Preferred methods include monitoring each approach path with a separate presence detector element, combining the aggregate of concurrent stimuli in the electronic circuitry, and providing a combined warning display signal to the visual display apparatus.

The method preferably includes using a timer and thereby maintaining the output signal for a set delay time after a stimulus has been received by the presence detector, and resetting the presence detector to a default setting at the end of the set delay time, thereby terminating the output signal.

Optionally, the method includes reinitializing the set delay time on the timer in response to stimulus in the respective approach path while the timer is timing a previous stimulus in the same approach path. The preferred set delay time is about 2 seconds to about 6 seconds after receiving the last stimulus.

DETAILED DESCRIPTION OF THE ILLUSTRATED EMBODIMENTS

Figure 1:
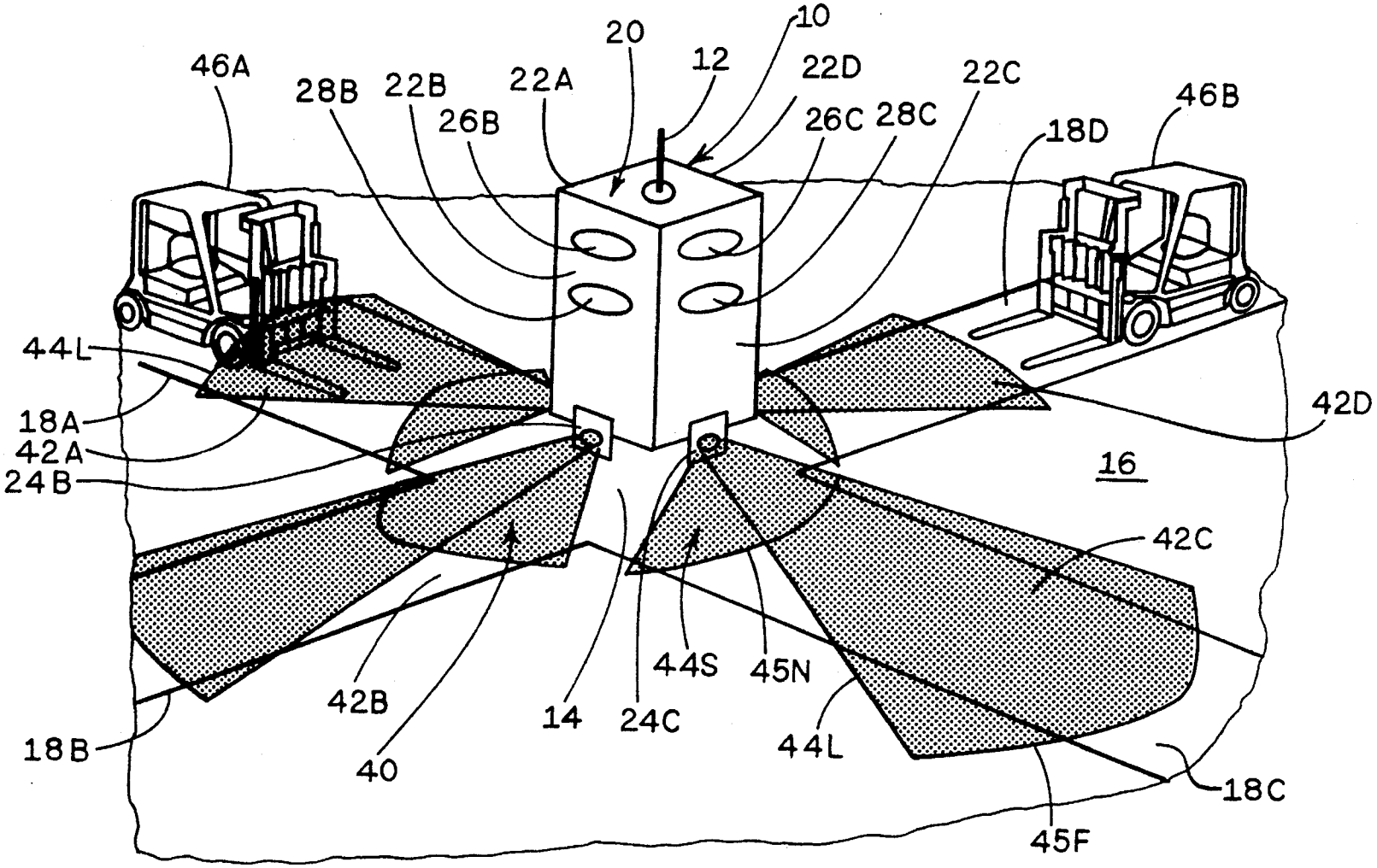
FIG. 1 shows a pictorial view of a traffic signalling system of the invention being used in a typical intersection in an industrial environment.
Figure 2:
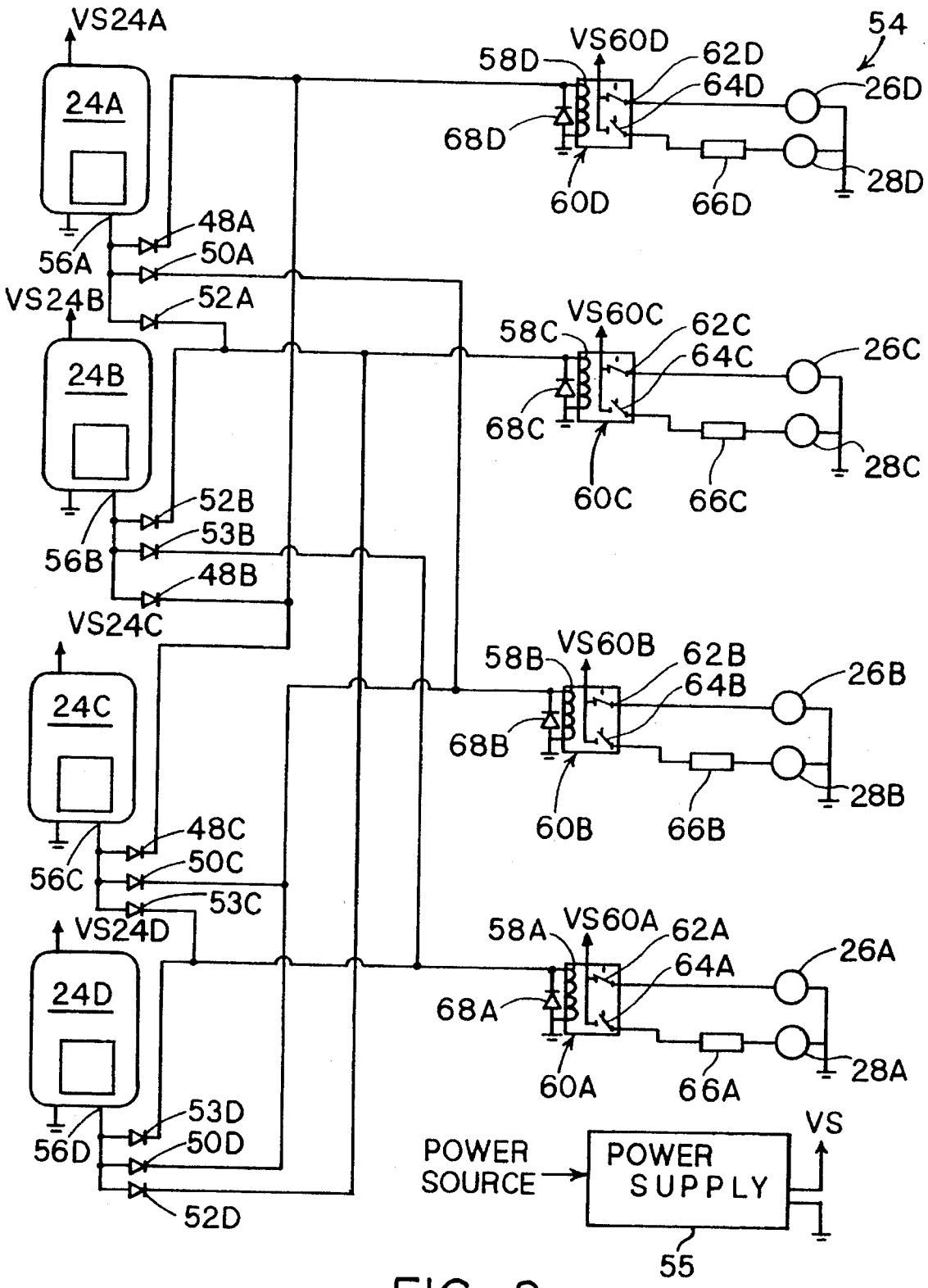
FIG. 2 is a representative schematic diagram of the traffic signalling system of FIG. 1.

Referring now by characters of reference to the drawings, and first to FIGS. 1 and 2, a traffic signalling system 10 is suspended by a support 12 over a typical intersection 14, in an industrial environment, at a height sufficiently high above the floor 16 to provide assured clearance for traffic traversing the intersection. Four approach paths 18A, 18B, 18C, and 18D lead into the intersection 14, providing paths upon which traffic approaches and traverses the intersection.

The traffic signalling system 10 comprises a housing 20 having four faces 22A, 22B, 22C, and 22D, each facing the corresponding approach path 18. The four faces 22A, 22B, 22C, and 22D support corresponding four presence detectors 24A, 24B, 24C, and 24D; corresponding four detection signal lights 26A, 26B, 26C, and 26D, which preferably give green light signals; and corresponding four warning signal lights 28A, 28B, 28C, and 28D, which preferably give yellow light signals. The presence detectors 24, the detection signal lights 26, and the warning signal lights 28 are shown only on faces 22B and 22C in FIG. 1, and are hidden on faces 22A and 22B.

In the default setting, where no traffic is being detected, all four green detection signal lights 26A, 26B, 26C, and 26D are illuminated, signalling that traffic may safely enter the intersection from any direction.

In general, the traffic signalling system 10 monitors a signal zone 40 defined by the combination of the approach path zones 42A, 42B, 42C, and 42D monitored by the respective presence detectors 24. Each approach path zone 42 is defined by the zone effectively monitored by the respective presence detector. Representative limits of the approach path zones are illustrated in FIG. 1 by respective pairs of shaded areas 44S and 44L of corresponding shorter and longer range in each of the approach paths 18. The approach path zones can be configured as desired, using installation and set procedures known for use with presence detectors. In general, the respective approach path zone 42 is effectively continuous at floor level between a near edge 45N and a far edge 45F, both measured with respect to the locus of the traffic signalling system 10. Near and far edges 45N and 45F above the floor generally correspond with the shapes of the vision zones defined in the respective presence detector. In preferred embodiments as used in industrial environments, the far edges 45F extend about 40–50 feet from the traffic signalling system 10. The signalling system 10 may, of course, be adapted to address larger or smaller signal zones 40, depending on the area which is to be monitored.

As traffic, such as lift truck 46A, enters the signal zone, the corresponding presence detector 24 detects the traffic, and the signalling system 10 signals the approach path being used by the detected traffic (e.g. approach path 18A), according to the identity of the presence detector that detected the traffic. The system 10 provides a first signal, warning traffic in the other approach paths (e.g. approach paths 18B, 18C, and 18D), and a second signal, different from the first warning signal, to traffic in the approach path (e.g. approach path 18A) where the traffic (lift truck 46A) was detected.

FIG. 2 illustrates the wiring layout of representative electrical processing circuitry 54 between the presence detectors 24 and the corresponding signal lights 26 and 28, for processing detection signals generated by the presence detectors and thereby producing the desired visual signals at detection signal lights 26 and warning signal lights 28.

A conventional power supply 55, such as Model FLU1-80-3ad, available from Unitrode Corporation, Canton, Mass., receives a commercially available feed stream of alternating current of 85 volts to 265 volts 60 Hz, from the power grid, converts the feed stream to form suitable for use in the electrical processing circuit 54 and supplies the converted power as a supply voltage $V_s$ to the various powered components in the electrical processing circuit, as illustrated in FIG. 2. In the embodiment illustrated in FIGS. 1 and 2, the input power supply is preferably 110 volts AC, and the output power is 12 volts DC. In an alternate arrangement, the power output from the power supply 55 can be a combination of alternating current used to power the signal lights 26 and 28 and the presence detectors 24, and direct current used to power the relay coils. Where the input voltage can be specified with certainty (e.g. 110 volts AC), standard transformer and bridge rectifier components can be used as the power supply. Transformed AC power connections can be taken ahead of the rectifier. DC power connections are taken after the rectifier.

The layout of the circuit 54, and corresponding operation of the lights, will first be described with respect to one presence detector 24 detecting, and responding to, a single target. The target preferably is a vehicle or human. The preferred presence detector 24 is a Model 6179 Infrared Motion Detector, available from Sentrol Inc., Portland, Oreg. In general, such detectors use a delay timer to set a delay time during which the detector continues to produce an output signal once signal output has commenced. After the delay time has run, the motion detector may reset to a default setting. The set delay time provides continuity of output signal even though the triggering stimulus may no longer be present. In the case of protecting an intersection, as in this invention, the delay generally provides time for the traffic to traverse, and clear, the intersection, typically about 2 seconds to about 6 seconds, preferably about 3 seconds to about 4 seconds.

The preferred Model 6179 detector features a retriggerable set delay time which continues to re-initialize the set delay time so long as the triggering stimulus continues to be received by the presence detector. Accordingly, each stimulus, up to and including the last stimulus received by the presence detector 24, re-initializes the set delay time. Thus, the signal output is not terminated until a period corresponding to the set delay time has passed since the last triggering stimulus was received by the presence detector 24.

In general, under typical conditions described below, the signalling system 10 gives a green light to the driver of a lift truck 46A first entering the signal zone 40, in e.g. approach path 18A, while giving a warning signal, in the form of blinking yellow lights 28B, 28C, and 28D, directed respectively to approach paths 18B, 18C, and 18D. As lift truck 46A enters the signal zone 40 by entering the shaded area 44L of approach path zone 42A (FIG. 1), presence detector 24A senses the presence of the lift truck, internally produces an alarm output, closing a contact (not shown) internal to the presence detector, that completes the circuit between the presence detector supply voltage $V_s$24A and the anodes of diodes 48A, 50A, and 52A, thus sending an output signal 56A (e.g. 12 volts DC) to the diodes.

The cathodes of the diodes 48A, 50A, and 52A are connected to ground through the energizing coils 58D, 58B, and 58C of control relays 60D, 60B, and 60C, respectively, whereby the coils 58D, 58B, and 58C are energized by the output signal 56A through diodes 48A, 50A, and 52A. This energized state of relays 60D, 60B, and 60C, activates the internal contacts of the relays 60D, 60B, and 60C, thus opening the normally closed relay contacts 62D, 62B, and 62C, and thereby extinguishing the green detection signal lights 26D, 26B, and 26C.

Activation of the internal contacts 62D, 62B, and 62C also closes the normally open relay contacts 64D, 64B, and 64C, thus completing the circuits between the supply voltages $V_s$60D, $V_s$60B, $V_s$60C, provided to the relays, and the respective flashers 66D, 66B, and 66C. Flashers 66 are elements which intermittently interrupt and reconnect the flow of power at predetermined intervals.

Supply voltages $V_s$ are thus supplied, through the flashers to one side of each of the yellow warning signal lights 28D, 28B, and 28C, at the predetermined intervals. The other side of each of the yellow warning signal lights is connected to ground, thus causing the yellow warning signal lights to illuminate at the predetermined intervals established through the flashers 66D, 66B, and 66C. Meantime, the green detection signal light 26A directed toward occupied approach path 18A remains illuminated, providing a signal to the driver of lift truck 46A indicating that the intersection may safely be entered and traversed. The presence detector 24A continues to receive, and respond to, stimulus from the lift truck 46A so long as the lift truck continues to traverse along the approach path zone 42A.

As the lift truck passes under the traffic signalling system 10, through the intersection 14, and travels away from the intersection on a second approach path (e.g. path 18C), the set delay time on presence detector 24A begins to run down, terminating the output signal 56A at the end of the delay time, and allowing the circuit to reset to the default setting shown in FIG. 2. Correspondingly, and potentially while the delay time on presence detector 24A is still running, a second presence detector, namely presence detector 24C, detects the departing target lift truck 46A in its approach path zone 42C, and generates a second output signal, beginning a second command sequence. Thus, presence detector 24C generates the second output signal 56C to a second set of diodes 48C, 50C, and 53C. The cathodes of the second set of diodes 48C, 50C, and 53C are connected to ground through the energizing coils 58A, 58B, and 58D of a second set of control relays 60A, 60B, and 60D, respectively, whereby the coils 58A, 58B, and 58D are energized by the second output signal 56C through the second set of diodes 48C, 50C, and 53C.

At that point in time, assuming the delay time on presence detector 24A is still running, both relays 60B and 60D are energized by the respective first and second output signals 56A and 56C from presence detector 24A and presence detector 24C. Relay 60C is energized by output signal 56A from presence detector 24A. Relay 60A is energized by output signal 56C from presence detector 24C.

The second output signal 56C activates the internal contacts of relay 60A, thus opening the normally closed relay contacts 62A, thereby extinguishing the green detection signal light 26A, and closing the normally open relay contact 64A and completing the circuit between the supply voltage $V_s$60A provided to the relay 60A, and the flasher 66A. Supply voltage $V_s$60A is thus supplied, through flasher 66A to one side of the yellow warning signal light 28A, at the predetermined intervals. The other side of the yellow warning signal light is connected to ground, thus causing the yellow warning signal light 28A to illuminate at the predetermined intervals. Thus, the green detection signal light 26A goes out and the yellow warning signal light 28A begins flashing. At that point in time, all the green detection signal lights are out, and all the yellow warning signal lights are flashing.

As the delay timer on presence detector 24A times out, the first output signal 56A is terminated. Relay 60C is de-energized, and returns to its default condition, whereby the yellow warning signal light 28C directed toward approach path 18C is extinguished, and corresponding green detection signal light 26C is illuminated. As relay 60C is de-energized, suppression diode 68C suppresses the negative portion of the collapsing magnetic field. Relays 60A, 60B, and 60D, have corresponding, similarly operating suppression diodes 68A, 68B, and 68D. Relays 60B and 60D remain energized by the second output signal 56C from presence detector 24C, whereby warning signal lights 28B and 28D remain energized through the respective flashers 66B and 66D. At that point, the yellow warning signal lights 28A, 28B, and 28D are flashing toward approach paths 18A, 18B, and 18D respectively, and green signal light 26C, directed toward approach path 18C, is continuously lit.

As lift truck 46A traverses approach path zone 42C along its departure course, presence detector 24C continues to detect lift truck 46A as a target, whereby the delay timer is repeatedly reinitialized such that the full delay time is set to run when the lift truck 46A exits the signal zone 40. As soon as the lift truck 46A exits the signal zone 40 at the far edge 45F of the approach path zone 42C, the presence detector 24C ceases detect the lift truck, and the corresponding delay timer in presence detector 24C begins to run down. When the delay timer in presence detector 24C has run its course, the output signal 56C is terminated. Relays 60A, 60B, and 60D are thus de-energized, and return to their default condition, whereby the yellow warning signal lights 28A, 28B, and 28D are de-energized, and corresponding green detection signal lights 26A, 26B, and 26D are illuminated. At that time, all the green detection signal lights are illuminated, indicating that the intersection can be safely traversed from any direction.

In the event a second lift truck 46B or other target enters the signal zone before the delay timer in presence detector 24C has run its course, the output signal 56 from the respective presence detector affects the lights 26 and 28 according to the principles above disclosed.

The above description has been given with respect to a single target lift truck traversing a straight path through the intersection, using approach paths 18A and 18C. The target may, of course, exit the intersection on one of the other paths (e.g. 18B or 18D), whereupon the description of events with respect to approach path 18C would play out in a corresponding manner for the approach path actually traversed.

Referring again to FIGS. 1 and 2 and the above discussion, as the second lift truck 46B enters the intersection after the first lift truck 46A has triggered the first output signal 56A at presence detector 24A, the presence detector 24B detects the lift truck 46B, triggering a corresponding output signal 56B, and corresponding light changes.

Thus, triggering the presence detector in a given approach path e.g. 18A positively illuminates the yellow flashing lights in all other approach paths. So long as no targets are detected in the other approach paths, the green light 26A in the triggering path 18A remains illuminated, indicating safe passage into and through the intersection. If targets are detected in one or more other approach paths, such detection will override the green light 26A, extinguishing the green light 26A and illuminating the flashing yellow warning light 28A.

Figure 3:
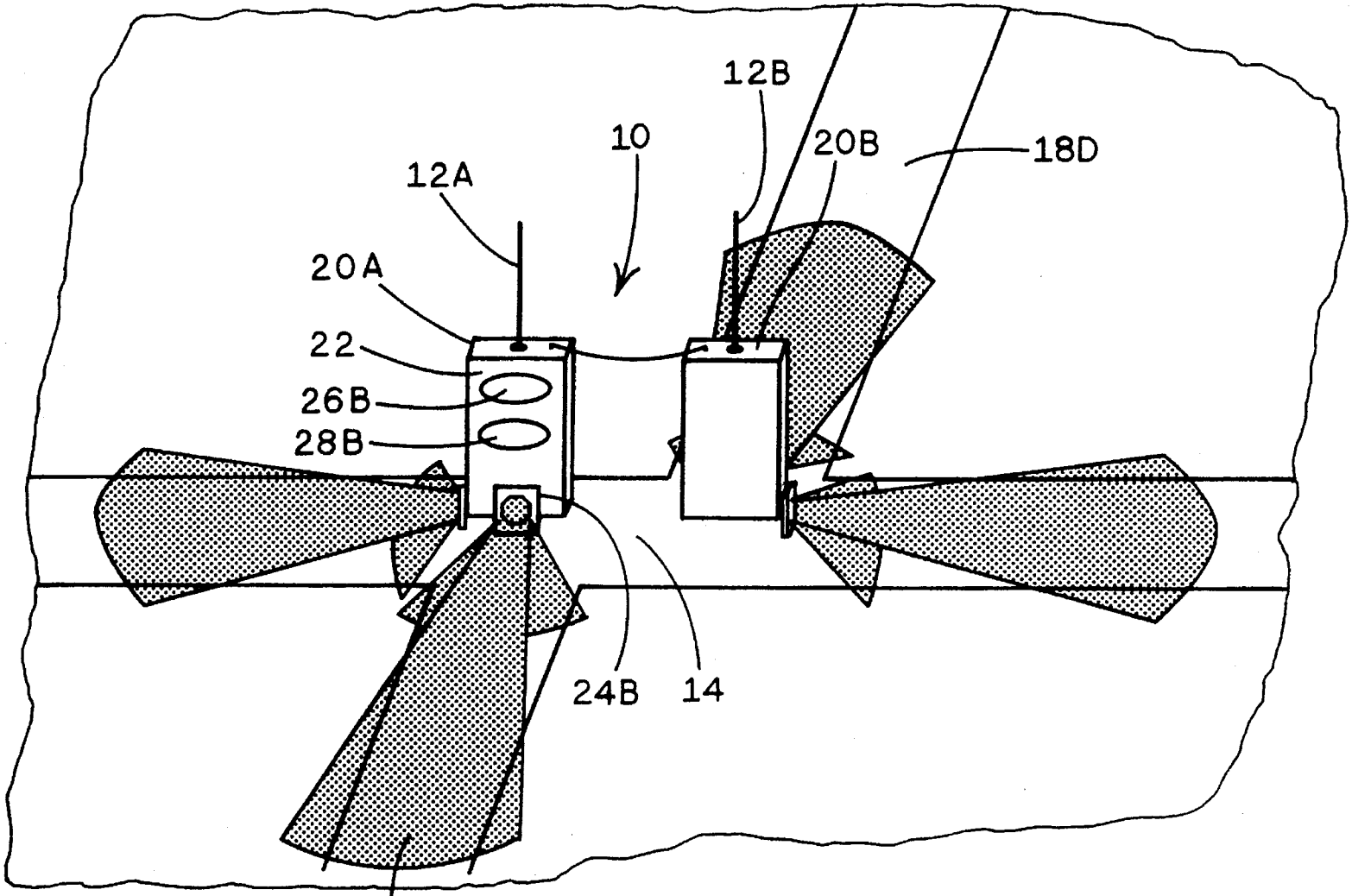
FIG. 3 shows the traffic signalling system of FIG. 1, modified for use at a split intersection.

FIG. 3 illustrates the use of the traffic signalling system 10 at a staggered intersection 14, wherein the approach paths 18B and 18D are offset from each other. As seen in FIG. 3, the signalling system is accordingly housed in two housings 20A and 20B, with each housing having two active faces 22 corresponding to the respective approach paths being monitored. The electrical circuitry, however, corresponds with the circuitry shown in FIG. 2, with affect only in the lengths of the various cables.

A single one of the housings 20A or 20B, with corresponding circuitry limited to use with presence detectors and signal lights 26 and 28 for two active faces, can be readily used for "L" corners where there is no crossing intersection. A "T" intersection, accordingly, is serviced with a traffic signalling system having three active faces 22, each active face including a presence detector 24, a detection signal light 26, and a warning signal light 28.

Figure 4:
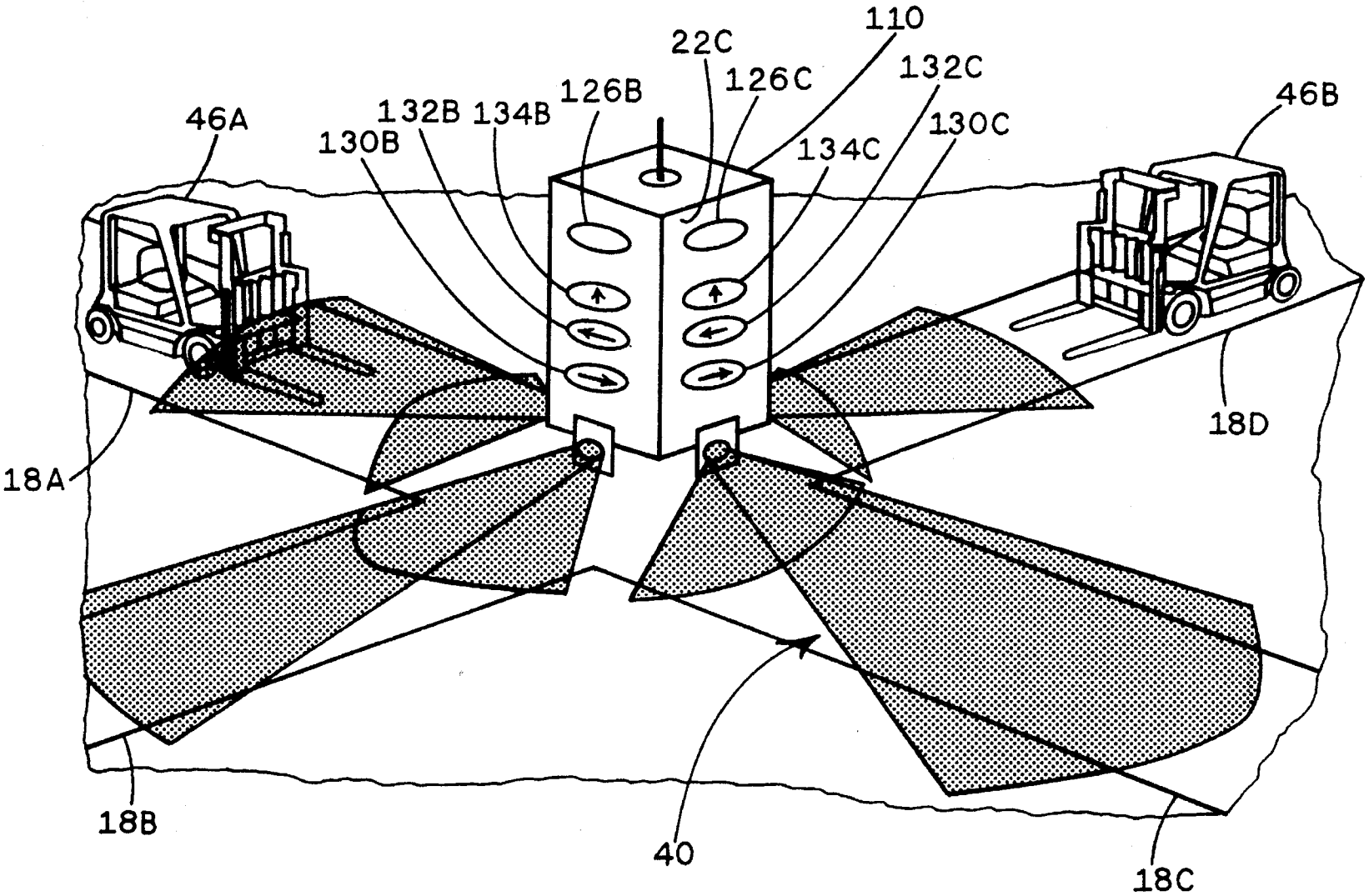
FIG. 4 shows a pictorial view of a second embodiment of the traffic signalling system of the invention being used, as in FIG. 1, in a typical intersection in an industrial environment.
Figure 5:
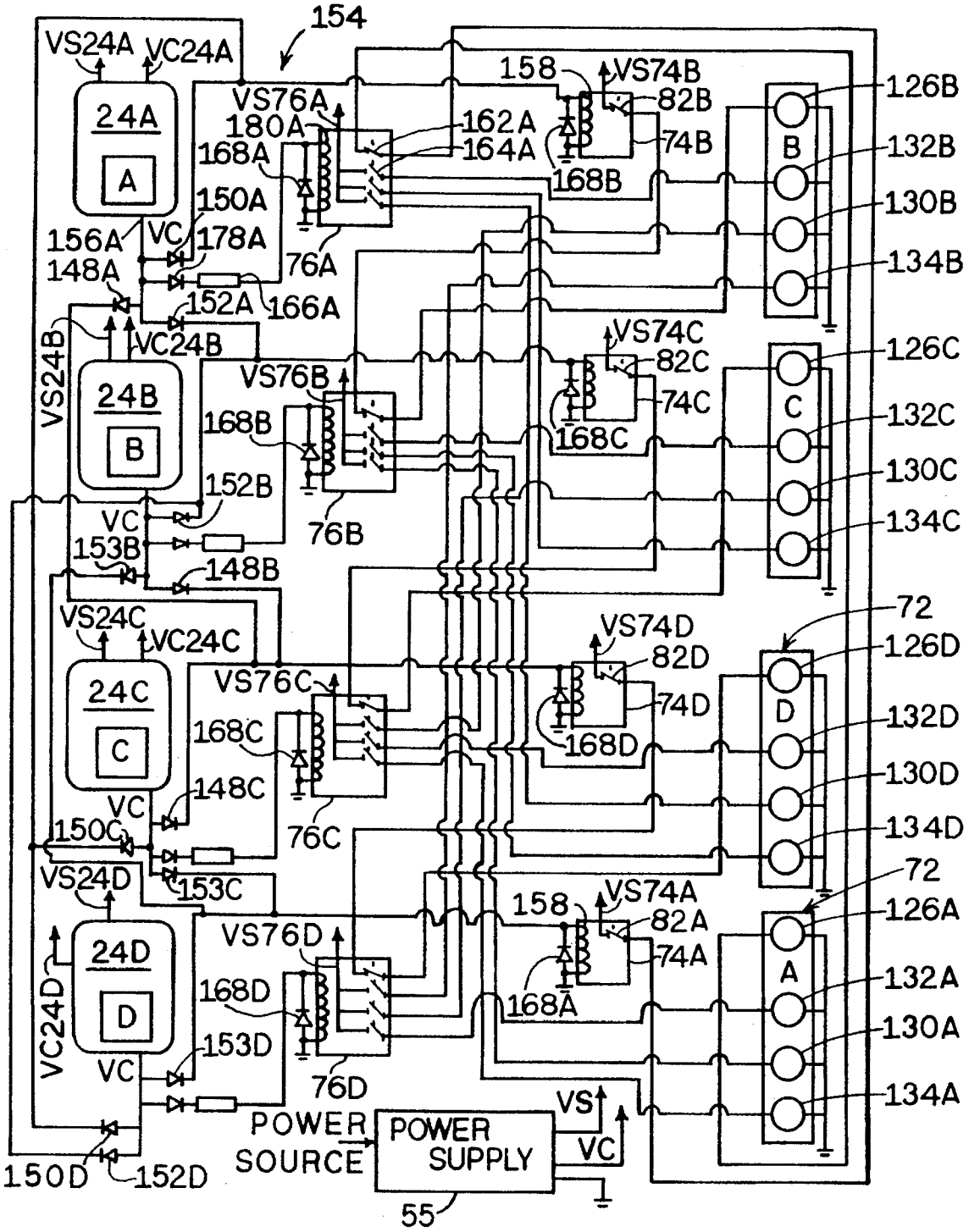
FIG. 5 is a representative schematic diagram of the embodiment shown in FIG. 4.

FIGS. 4 and 5 illustrate a second embodiment of the invention. Referring to FIGS. 4 and 5, the single yellow warning signal light 28 on each face 22 has been replaced with three warning signal lights 130, 132, and 134. A warning signal light 130, as seen by a viewer in the respective approach path, includes the image of an arrow therein pointing to the right. When warning signal light 130 is illuminated, it signifies traffic being detected in the approach path 18 on the viewer's right. A warning signal light 132, as seen by a viewer in the respective approach path, includes the image of an arrow therein pointing to the left. When warning signal light 132 is illuminated, it signifies traffic being detected in the approach path 18 on the viewer's left. Warning signal light 134, as seen by a viewer in the respective approach path, includes the image of an arrow therein pointing up. When warning signal light 134 is illuminated, it signifies traffic being detected in the approach path 18 ahead of the viewer.

In this embodiment of FIGS. 4 and 5, when a target is detected, the proper one of the yellow warning signal lights 130, 132, or 134 is illuminated, as a flashing signal, in each approach path to indicate to a viewer, in the respective approach path, the path where the traffic was detected. If traffic is detected in more than one approach path, a corresponding more than one of yellow warning signal lights 130, 132, 134 are illuminated, as flashing signals, at each face 22, one light 130, 132, 134 for each path where a target is detected.

As will be seen in the discussion of the wiring layout for this embodiment, shown in FIG. 5, the green signal lights 126 are illuminated steadily when no target is detected. When a target is detected, all the steady green lights 126 are extinguished, and the green light 126 in the approach path 18 where the target is detected is illuminated as a blinking green light, indicating to the target driver that he or she has been detected. If targets are detected in two or more approach paths 18, the corresponding two or more yellow warning signal lights 130, 132, and 134 are illuminated, as multiple flashing signals, at each face to indicate, to the viewer in the respective path, all the paths wherein at least one target is detected.

In general, the wiring diagram of FIG. 5 shows a circuit 154 having a set of four presence detectors 24, a corresponding visual display including four banks 72 of visual display lights 126, 130, 132, and 134, which give visual indications regarding traffic in or approaching the intersection, "rest" relays 74 which control the visual displays when no targets are detected, and a corresponding set of four "action" relays 76 which control the visual display when one or more targets are detected.

A power supply 55, comprising a transformer (not shown) and a bridge rectifier (not shown), receives standard 110 volts 60 Hz AC from the power grid, transforms it to 12 volts 60 Hz AC, supplying the 12 volts AC to the presence detectors 24A, 24B, 24C, and 24D, the rest relays 74A, 74B, 74C, and 74D, and the action relays 76A, 76B, 76C, and 76D, all as indicated at $V_s$ at the respective elements. A portion of the transformed 12 volt AC current is further processed in power supply 55, through the conventional bridge rectifier, to 12 volts DC. The 12 volt DC current is supplied to the presence detectors as shown at $V_c$, to provide power to the coils 158 of rest relays 74 and the coils 180 of action relays 76.

The layout of the circuit 154 is as follows. There are four presence detectors 24A, 24B, 24C, and 24D, one for each approach path contemplated for use with the traffic signalling system 110. Four rest relays 74A, 74B, 74C, and 74D, have normally closed contacts 82 which normally close the circuit between one side of the signal lights 126A, 126B, 126C, and 126D and the respective power supplies $V_s$74. Each presence detector 24 is connected, through three corresponding diodes, to the corresponding coils of opposing rest relays 74.

By "opposing" rest relays, we mean the rest relays bearing a suffix different from the suffix of the presence detector 24 being addressed. Thus, with respect to presence detector 24A, the opposing rest relays are relays 74B, 74C, and 74D.

Each presence detector 24 is connected, through a fourth diode 178 and corresponding flasher 166, to the coil of its action relay 76. Thus, presence detector 24A is connected to action relay 76A, and presence detector 24B is connected to action relay 76B. Each action relay 76 has a first set of normally closed contacts 162, and three sets of normally open contacts 164. The normally closed contacts 162 complete the circuit between the signal light 126 for respective approach path and the supply voltage $V_s$ indicated at the respective relay 76. The normally open contacts 164, when closed, complete the circuits between the voltage supply $V_s$ at the respective active relay 76 and corresponding yellow warning display lights 130, 132, or 134 indicative of the approach path where the target has been detected, at the respective opposing banks 72 of visual display lights. Thus, the normally open contacts 164A in active relay 76A, when closed, complete circuits between the voltage supply $V_s$76A at relay 76A and the yellow lights 132B, 134C, and 130D.

Throughout the operation of the traffic signalling system of the invention, relay coils 158 and 180 are periodically energized and de-energized. Suppression diodes 168 on each of the rest relays 74 and each of the action relays 76 suppress the negative portions of collapsing magnetic fields as the respective relay coils 158 and 180 are de-energized.

The operation of the lights, will now be described with respect to presence detector 24A detecting, and responding to, a single target. In general, under typical conditions described herein, when no activity is detected in the signal zone 40, the traffic signalling system 110 is "at rest." Accordingly, the green light 126 is illuminated on each face 22, directed toward each respective approach path 18. In that regard, the contact on each of the rest relays 74 is closed as shown, the respective coils 158 are not energized, and power is supplied to the respective green signal lights 126 from the respective power supply inputs $V_s$ shown at the rest relays 74.

As the lift truck 46A enters the signal zone 40, presence detector 24A senses the presence of the lift truck, internally produces an alarm output, closing a contact (not shown) internal to the presence detector, that completes the circuit between the respective supply voltage $V_c$24A at presence detector 24A, and the anodes of diodes 148A, 150A, 152A, and 178A, thus sending an output signal 156A to the diodes.

The cathodes of the diodes 148A, 150A, and 152A are connected to ground through the energizing coils 158D, 158B, and 158C of rest relays 74D, 74B, and 74C, respectively, whereby the coils 158D, 158B, and 158C are energized by the output signal 156A through diodes 148A, 150A, and 152A. This energized state of rest relays 74D, 74B, and 74C activates the internal contacts 82 of the rest relays 74D, 74B, and 74C, thus opening the normally closed relay contacts 82D, 82B, and 82C, and thereby extinguishing the steady-green signal lights 126D, 126B, and 126C. The steady green light 126A is not affected by diodes 148A, 150A, or 152A, and remains energized through $V_s$74A and rest relay 74A.

The cathode of the flasher diode 178A is connected to ground through the flasher 166A and the energizing coil 180A of action relay 76A, whereby the coil 180A is intermittently energized by the output signal 156A through flasher diode 178A and flasher 166A, at the predetermined interval of the flasher 166A. This intermittent energized state of relay 76A intermittently activates the internal contacts of relay 76A, thus intermittently opening and closing the normally closed relay contacts 162A. The intermittent opening and closing of the relay contacts 162A intermittently opens and closes the circuit between $V_s$74A and the green light 126A, at contacts 162A. Accordingly, when the system 110 begins to respond to the entrance of the lift truck into the signal zone, the steady green light 126A begins to flash, signalling to the driver that he has been detected, and that he is the only target detected in the signal zone.

Activation of the internal contacts in the action relay 76A also intermittently opens and closes the three sets of normally open relay contacts 164A, completing the circuits between the supply voltage $V_s$76A and the yellow lights 132B, 134C, and 130D at the respective banks 72B, 72C, and 72D of visual displays. Supply voltages $V_s$ are thus supplied intermittently, through the relay 76A, to one side of each of the yellow warning signal lights 132B, 134C, and 130D, at the predetermined intervals of flasher 166A. The other side of each of the yellow warning signal lights is connected to ground, whereby the yellow warning signal lights 132B, 134C, and 130D flash their warnings to present or potential occupants of approach paths 18B, 18C, and 18D, in each case indicating by means of the image of directive arrows in the flashing yellow lights, that a target has been detected in approach path 18A.

As in the embodiment of FIGS. 1–2, the presence detector 24 preferably continues to re-initialize its delay timer so long as the target continues to be detected in the respective approach path. Accordingly, the running of the delay timer is effectively forestalled until such time as the target is no longer detected in the respective approach path.

As with respect to the embodiment of FIG. 1 and 2, as the lift truck traverses the intersection, the delay timer in presence detector 24A begins to run down; and the presence detector in the departure path (e.g. 18C) detects, and responds to, the lift truck 46A. When presence detector 24C responds to the lift truck 46A, and using the same circuit analysis, it extinguishes the blinking green light 126A by energizing coil 158 of rest relay 74A, and thus opening the normally closed contacts 82A at rest relay 74A. The response of presence detector 24C energizes action coil 76C, which energizes the corresponding blinking yellow lights 130B, 132D, and 134A. Action relay 76C sends a blinker signal to rest relay 74C, activating blinking of green light 126C. However, the power supply $V_s$74C to light 126C remains interrupted by the signal 156A through diode 152A until such time as presence detector 24A is reset when the delay timer in presence detector 24A times out. Thus, the traffic signalling system 110, as in system 10, combines the aggregate of concurrent output signals from the concurrent or nearly concurrent stimuli, to generate a combination of warning display signals, and a combined set of light displays, indicating traffic conditions in the signal zone.

If a second target vehicle, such as lift truck 46B in approach path 18D, enters the signal zone 40 while the above activity is occurring, the presence detector 24D will detect the second target in approach path 18D, and will illuminate yellow blinking lights 130C, 132A, and 134B, indicating the presence of lift truck 46B in the signal zone 40, and that lift truck 46B is in the approach path 18D. In this way, the traffic signalling system 110 of FIGS. 4–5 indicates, in a visual display directed toward each approach path, each approach path where a target is detected. Where a target is detected in only one approach path, a blinking green light is also displayed in the approach path where the target is detected. Where targets are indicated in more than one approach path at the same time, all green lights are extinguished. None blink. Thus, each driver or pedestrian is warned that there is other activity in or near the intersection.

The signal zone is sized with respect to the density and speed of traffic expected to traverse the signal zone. In an industrial environment, which is contemplated as the primary use of the invention, the signal zone will typically extend about 40–50 feet from the center of the intersection as suggested above. For other applications of traffic signalling systems of the invention, the signal zone may extend for greater or lesser distances, depending on the demands of the application.

The term "presence detector" as used herein includes any detection device which can detect the presence, or motion, of a body within the signal zone. Such detectors which are generally known as, for example, "motion" detectors, are within the scope of the presence detectors 24 contemplated herein. For example, the above recited preferred presence detector from Sentrol Inc. is generally known as an infrared "motion" detector, and operates by detecting infrared signals that indicate motion in the signal zone. As shown in e.g. FIGS. 1 and 2, the four presence detectors 24, in combination, monitor an area that, in combination, defines the signal zone 40.

The presence detectors contemplated herein operate in a wide range of frequencies generally outside the band of visible light and outside the band of audible sound frequencies. Indeed, all usable frequencies except those representing audible sound and visible light are contemplated to be within the scope of the invention. Accordingly, in addition to the infrared frequencies, exemplary frequencies contemplated by the inventors are microwave frequencies, radar and radio frequencies, ultrasonic frequencies, and the like, as well as laser-based detection. Accordingly, as used in the claims that follow, recitation of the presence detector as receiving a stimulus at one or more frequencies outside the human visible spectrum, we specifically include in the scope of the presence detector those laser-based presence detectors which may detect laser transmissions, even though such transmissions are in the visible spectrum.

The invention has been described in terms of using a plurality of presence detectors 24, one directed toward each approach path 18, with each presence detector having its own circuitry for processing a target detection, and generating an output signal to the respective diodes. Applicants also contemplate embodiments using a single presence detector, having multiple target detector elements, and processing the target detections through a single electrical processing circuitry. The design of such circuitry is well within the capability of one of ordinary skill in the art, and a variety of such circuits may be so designed, all serving substantially the function set forth herein.

The description herein has discussed targets in terms of lift trucks. A variety of targets, including humans may be detected, depending on the sensitivity of the presence detectors used. The target preferably includes each vehicle and human in the signal zone. Selection and control of the threshold sensitivity to stimulus, namely the threshold intensity of the stimulus, and the types of stimuli which will be detected, are well within the skill of the art, and all conventional characterizations of detectable activity and presences, and all conventional threshold levels of sensitivity, are contemplated for use herein.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A traffic signalling system, for detecting targets contained in any of at least two approach paths in a signal zone, and for providing signals responsive to the targets detected, said traffic signalling system comprising:

(a) a presence detector effective to receive a minimum threshold stimulus, at one or more frequencies outside the human visible spectrum and outside the human audible spectrum, from each target, including each vehicle and each human, entering the signal zone in any one of the at least two approach paths, and to generate output signals responsive to the stimuli so received;

(b) visual display apparatus for directing visual displays toward each of the at least two approach paths; and (c) electrical processing circuitry for receiving and processing output signals from said presence detector, and for delivering corresponding warning display signals to said visual display apparatus, directing visual warning displays, representing the presence of the respective target, toward each of the at least two approach paths outside the approach path occupied by the respective target.

2. A traffic signalling system as in claim 1, said electrical processing circuitry being adapted to deliver, to said visual display apparatus, detection display signals, responsive to output signals received from said presence detector, thereby to direct a second visual display, different from the visual warning display, representing the presence of the respective target, toward the approach path occupied by the respective target.

3. A traffic signalling system as in claim 2, said visual display apparatus being adapted to indicate, in the visual warning displays directed toward each approach path outside the approach path occupied by the respective target, the approach path occupied by the respective target.

4. A traffic signalling system as in claim 2, said traffic signalling system being adapted to concurrently receive and process first and second stimuli from first and second targets in respective first and second different ones of the approach paths, to concurrently generate respective first and second warning display signals from the first and second stimuli, and concurrently deliver the first and second warning display signals to said visual display apparatus, indicating concurrent presence of the respective first and second targets in the respective approach paths, whereby said visual display apparatus concurrently directs visual warning displays, indicating presence of at least a second target in the signal zone, to each of the first and second approach paths.

5. A traffic signalling system as in claim 2, said traffic signalling system being adapted to concurrently receive and process first and second stimuli from first and second targets in respective first and second different ones of the approach paths, to concurrently generate respective first and second warning display signals from the first and second stimuli, and to concurrently deliver the first and second warning display signals to said visual display apparatus, indicating concurrent presence of the respective first and second targets in the respective approach paths, the first and second warning display signals being generated from corresponding first and second output signals, the first and second warning display signals, in combination, suppressing any corresponding detection display signal, whereby said visual display apparatus concurrently directs visual warning displays indicating the presence of at least a second target in the signal zone, to each of the first and second approach paths, and prevents display of the detection display signal.

6. A traffic signalling system as in claim 2 said electrical processing circuitry being adapted to generate corresponding ones of the warning display signals and the detection display signals from a common output signal received from said presence detector.

7. A traffic signalling system as in claim 3, said traffic signalling system being adapted to concurrently receive and process first and second stimuli from first and second targets in respective first and second different ones of the approach paths, thereby to concurrently generate respective first and second warning display signals and to concurrently deliver the first and second warning display signals to said visual display apparatus, and to indicate by the visual display, to each of the at least two approach paths, the presence of respective targets in each of the approach paths outside the approach path to which the visual display is directed, along with identification of the approach paths so occupied by the targets.

8. A traffic signalling system as in claim 3, said traffic signalling system being adapted to concurrently receive and process first and second stimuli from first and second targets in respective first and second different ones of the approach paths, to concurrently generate respective first and second warning display signals from the first and second stimuli, and to concurrently deliver the first and second warning display signals to said visual display apparatus, indicating concurrent presence of the respective first and second targets in the respective approach paths, the first and second warning display signals being generated from corresponding first and second output signals, the first and second warning display signals, in combination, suppressing any corresponding detection display signal, whereby said visual display apparatus concurrently directs visual warning displays indicating the presence of at least a second target in the signal zone, to each of the first and second approach paths, and prevents display of the detection display signal.

9. A traffic signalling system as in claim 1, said traffic signalling system including a timer for maintaining the output signal for a set delay time after a stimulus has been received by said presence detector, and reset circuitry for resetting the presence detector to a default setting at the end of the set delay time, thereby terminating the output signal.

10. A traffic signalling system as in claim 9, said traffic signalling system including override circuitry for reinitializing the set delay time on said timer in response to stimulus in the respective approach path while said timer is timing a previous stimulus in the same approach path.

11. A traffic signalling system as in claim 9, said timer having a set delay time of about 2 seconds to about 6 seconds.

12. A traffic signalling system as in claim 10, said traffic signalling system including an adjustment for adjusting the time over which said timer maintains the output signal after a stimulus has been received by said presence detector.

13. A traffic signalling system as in claim 1, said presence detector comprising a plurality of presence detector elements corresponding in number to the number of approach paths, each said presence detector element being mounted in said traffic signalling system for disposition toward a respective approach path.

14. A traffic signalling system as in claim 13, said presence detector elements comprising motion detectors.

15. A traffic signalling system as in claim 1, said presence detector comprising a motion detector.

16. A traffic signalling system as in claim 15, said motion detectors comprising infrared motion detectors adapted to detect moving bodies, using infrared frequencies.

17. A traffic signalling system as in claim 1, said visual display apparatus being adapted to indicate, in the visual warning displays directed toward each approach path outside the approach path occupied by the respective target, the approach path occupied by the respective target.

18. A traffic signalling system as in claim 17, said traffic signalling system being adapted to concurrently receive and process first and second stimuli from first and second targets in respective first and second different ones of the approach paths, thereby to concurrently generate respective first and second warning display signals and to concurrently deliver the first and second warning display signals to said visual display apparatus and to indicate, by the visual display toward each of the at least two approach paths, the presence of respective targets in each of the approach paths outside the approach path toward which the visual display is directed, along with identification of the approach paths so occupied by the targets.

19. A traffic signalling system as in claim 1, said traffic signalling system being adapted to concurrently receive and process first and second stimuli from first and second targets in respective first and second different ones of the approach paths, to concurrently generate respective first and second warning display signals from the first and second stimuli, and to concurrently deliver the first and second warning display signals to said visual display apparatus, indicating concurrent presence of the respective first and second targets in the respective approach paths, whereby said visual display apparatus concurrently directs visual warning displays, indicating presence of at least a second target in the signal zone, to each of the first and second approach paths.

20. A method for signalling traffic, by detecting targets in a signal zone having at least two approach paths, and providing signals responsive to targets detected, said method comprising the steps of:

(a) detecting the presence of each target in any of the approach paths, using a presence detector effective to receive a minimum threshold stimulus, at one or more frequencies outside the human visible spectrum and outside the human audible spectrum, from each target, including each vehicle and each human entering the signal zone in any one of the at least two approach paths and to generate output signals responsive to the stimuli so received;

(b) receiving and processing output signals from the presence detector in electrical processing circuitry, and delivering corresponding warning display signals from the electrical processing circuitry to a visual display apparatus; and (c) directing visual warning displays, responsive to corresponding warning display signals, representing the presence of the respective target, toward each of the at least two approach paths outside the approach path occupied by the respective target.

21. A method for signalling traffic as in claim 20, including delivering, from the electrical processing circuitry to the visual display apparatus, detection display signals, responsive to output signals received from the presence detector, thereby directing a second visual display, different from the visual warning display, representing the presence of the respective target, toward the approach path occupied by the respective target.

22. A method for signalling traffic as in claim 21, including indicating, in the visual warning displays directed toward each approach path outside the approach path occupied by the respective target, the approach path occupied by the respective target.

23. A method for signalling traffic as in claim 21, including concurrently receiving and processing first and second stimuli from first and second targets in respective first and second different ones of the approach paths, and concurrently generating respective first and second warning display signals from the first and second stimuli and concurrently delivering the first and second warning display signals to the visual display apparatus, indicating concurrent presence of the respective first and second targets in the respective approach paths, thereby concurrently directing visual warning displays, indicating presence of at least a second target in the signal zone, to each of the first and second approach paths.

24. A method for signalling traffic as in claim 21, including concurrently receiving and processing first and second stimuli from first and second targets in respective first and second different ones of the approach paths and concurrently generating corresponding first and second output signals from the first and second stimuli, and generating corresponding first and second warning display signals from the respective output signals, concurrently delivering the first and second warning display signals to the visual display apparatus, indicating concurrent presence of the respective first and second targets in the respective approach paths, and suppressing any corresponding detection display signal, thereby concurrently directing visual warning displays indicating the presence of at least a second target in the signal zone, to each of the first and second approach paths, and preventing display of the detection display signal.

25. A method for signalling traffic as in claim 21, including generating, in the electrical processing circuitry, corresponding ones of the warning display signals and the detection display signals from a common output signal received from the presence detector.

26. A method for signalling traffic as in claim 22, including concurrently receiving and processing first and second stimuli from first and second targets in respective first and second different ones of the approach paths, and concurrently generating respective first and second warning display signals and concurrently delivering the first and second warning display signals to the visual display apparatus, and indicating by visual warning displays directed toward each of the at least two approach paths, the presence of respective targets in each of the approach paths outside the approach path to which the respective warning displays are directed, along with the identity of the approach paths so occupied by the targets.

27. A method for signalling traffic as in claim 22, including concurrently receiving and processing first and second stimuli from first and second targets in respective first and second different ones of the approach paths and concurrently generating corresponding first and second output signals from the first and second stimuli, and generating corresponding first and second warning display signals from the respective output signals, concurrently delivering the first and second warning display signals to the visual display apparatus, indicating concurrent presence of the respective first and second targets in the respective approach paths, and suppressing any corresponding detecting display signal, thereby concurrently directing visual warning displays indicating the presence of at least a second target in the signal zone, to each of the first and second approach paths, and preventing display of the detection display signal.

28. A method for signalling traffic as in claim 20, and including using a timer and thereby maintaining the output signal for a set delay time after a stimulus has been received by the presence detector, and resetting the presence detector to a default setting at the end of the set delay time, thereby terminating the output signal.

29. A method for signalling traffic as in claim 28, including reinitializing the set delay time on the timer in response to stimulus in the respective approach path while the timer is timing a previous stimulus in the same approach path.

30. A method for signalling traffic as in claim 28, including maintaining the output signal for about 2 seconds to about 6 seconds after receiving the last stimulus.

31. A method for signalling traffic as in claim 28, including adjusting the time over which the timer maintains the output signal after a stimulus has been received by said presence detector.

32. A method for signalling traffic as in claim 20, including indicating, in the visual warning display directed toward each approach path outside the approach path occupied by the respective target, the approach path occupied by the respective.

33. A method for signalling traffic as in claim 32, including concurrently receiving and processing first and second stimuli from first and second targets in respective first and second different ones of the approach paths, and concurrently generating respective first and second warning display signals and concurrently delivering the first and second warning display signals to the visual display apparatus, and indicating by visual warning displays directed toward each of the at least two approach paths, the presence of respective targets in each of the approach paths outside the approach path to which the respective warning displays are directed, along with the identity of the approach paths so occupied by the targets.

34. A method for signalling traffic as in claim 20, including concurrently receiving and processing first and second stimuli from first and second targets in respective first and second ones of the approach paths, and concurrently generating respective first and second warning display signals from the first and second stimuli and concurrently delivering the first and second warning display signals to the visual display apparatus, indicating concurrent presence of the respective first and second targets in the respective approach paths, thereby concurrently directing visual warning displays, indicating presence of at least a second target in the signal zone, to each of the first and second approach paths.

35. A method for signalling traffic as in claim 20, including monitoring each approach path with a separate presence detector element, combining the aggregate of concurrent stimuli in the electronic circuitry, and providing a combined warning display signal to the visual display apparatus.

36. A method for signalling traffic as in claim 20 wherein the presence detector comprises a motion detector.

* * * * *